US009884325B2

(12) United States Patent
Kramer

(10) Patent No.: US 9,884,325 B2
(45) Date of Patent: Feb. 6, 2018

(54) HYDROCYCLONE WITH FINE MATERIAL DEPLETION IN THE CYCLONE UNDERFLOW

(71) Applicant: Andritz AG, Graz (AT)

(72) Inventor: Michael Kramer, Graz (AT)

(73) Assignee: Andritz AG, Graz (AT)

( * ) Notice: Subject to any disclaimer, the term of this patent is extended or adjusted under 35 U.S.C. 154(b) by 0 days.

(21) Appl. No.: 15/230,583

(22) Filed: Aug. 8, 2016

(65) Prior Publication Data

US 2017/0050191 A1 Feb. 23, 2017

(30) Foreign Application Priority Data

Aug. 21, 2015 (AT) ..... A 557/2015

(51) Int. Cl.

| | |
|---|---|
| ***B04C 5/14*** | (2006.01) |
| ***B03B 5/34*** | (2006.01) |
| ***B04C 5/04*** | (2006.01) |
| ***B04C 5/081*** | (2006.01) |
| *B04C 5/103* | (2006.01) |

(52) U.S. Cl.

CPC ..... *B03B 5/34* (2013.01); *B04C 5/04* (2013.01); *B04C 5/081* (2013.01); *B04C 5/14* (2013.01); *B04C 5/103* (2013.01)

(58) Field of Classification Search

CPC .... B04C 5/02; B04C 5/04; B04C 5/14; B04C 5/18; B04C 5/103

See application file for complete search history.

(56) References Cited

U.S. PATENT DOCUMENTS

| | | | | | |
|---|---|---|---|---|---|
| 1,509,915 | A * | 9/1924 | Stebbins | B07B 7/08 | 209/139.2 |
| 3,331,193 | A * | 7/1967 | Woodruff | B04C 5/14 | 209/731 |
| 3,716,137 | A * | 2/1973 | Frykhult | B04C 5/14 | 209/719 |
| 4,623,458 | A * | 11/1986 | Hakola | B01D 45/12 | 209/139.2 |
| 4,652,363 | A * | 3/1987 | Miller | B04C 5/02 | 209/734 |
| 4,696,737 | A * | 9/1987 | Bouchillon | B04C 5/00 | 209/210 |
| 4,969,934 | A * | 11/1990 | Kusik | B01D 46/26 | 95/270 |

(Continued)

FOREIGN PATENT DOCUMENTS

WO WO 2013/117342 8/2013

*Primary Examiner* — Joseph C Rodriguez
(74) *Attorney, Agent, or Firm* — Alix, Yale & Ristas, LLP

(57) ABSTRACT

A hydrocyclone with an inflow region providing tangential inflow for a feed slurry and with a separation region following the inflow region with an underflow discharge pipe to carry off heavy materials and with an overflow nozzle in the form of an immersion tube projecting axially into the interior of the hydrocyclone. Another inflow is provided in the area of the tangential inflow to supply the barrier fluid, where the barrier fluid and the feed slurry are separated from one another by a lamella in the hydrocyclone before they are brought together. The separation region includes a conical section and a subsequent cylindrical section above the underflow discharge pipe.

15 Claims, 3 Drawing Sheets

(56) References Cited

U.S. PATENT DOCUMENTS

| | | | | |
|---|---|---|---|---|
| 4,980,064 | A * | 12/1990 | Carroll | B01D 17/0217 209/733 |
| 7,255,790 | B2 * | 8/2007 | Rogers | B04C 5/12 209/715 |
| 7,404,491 | B2 * | 7/2008 | Hakola | B01D 45/12 209/715 |
| 7,434,696 | B2 * | 10/2008 | Soto | B04C 5/13 209/732 |
| 9,139,449 | B2 * | 9/2015 | Kramer | B04C 5/26 |
| 2010/0139492 | A1 * | 6/2010 | Fichman | B01D 45/16 96/319 |

* cited by examiner

HYDROCYCLONE WITH FINE MATERIAL DEPLETION IN THE CYCLONE UNDERFLOW

BACKGROUND

The present invention relates to a hydrocyclone with an inflow region providing tangential inflow for a feed slurry and a separation region following the inflow region with an underflow discharge pipe to carry off heavy materials and an overflow nozzle projecting into the interior of the hydrocyclone.

Generally, a hydrocyclone comprises a cylindrical segment with a tangential inflow (inlet nozzle) and a subsequent conical segment with the underflow nozzle or apex nozzle. The vortex finder or overflow nozzle projects axially from above in the form of an immersion tube into the interior of the cyclone.

The designations "upward(s)" and "downward(s)" in the present description refer to the overflow (specifically lighter and/or finer-grained fraction) and the underflow (specifically heavier and/or coarser fraction). However, the actual positioning of the hydrocyclone largely does not depend on this, so horizontally installed hydrocyclones are also frequently used.

Hydrocyclones are separation units which are used to separate mixtures of solids on the basis of different sinking speeds. In this process, the fractions are not separated fully from one another, and the large differences in the sinking speed are substantiated with greatly varying probabilities of reaching the respective coarse or fine particle outlet.

As a rule, the suspension is fed to the head piece of the cyclone, forced from there into a downward orbit and accelerated into the resulting downward spiral due to the conical taper of the bottom cyclone section. This acceleration and the resulting centrifugal forces create a strong force field that drives all particles that are specifically heavier than the surrounding fluid outwards, while all of the lighter particles are conveyed inwards. The layers close to the core in the overflow stream flowing upwards are detached along the entire downward spiral. The thickened stream discharged at the bottom is called the underflow, and the upwardly discharged stream is designated as the overflow or top flow.

Naturally, the overflow stream contains significantly less solids than the outer streams flowing downwards. In addition, particles with a very low sinking speed have a much higher probability of entering the overflow stream than is the case for the coarse-grained fractions, with the result that the overflow is enriched with fines (relatively in relation to the solids mass). However, the reverse is true in terms of the volume (in mg/l)—in relation to the volume flow discharged, the fines are depleted in the overflow in fine fractions if these fractions have a higher specific weight than the fluid.

Thus, the fines concentration in the underflow increases (often unintentionally) in relation to the fluid volume removed.

In order to prevent this, a wash water cyclone was developed with the aim of creating a barrier water layer (auxiliary sedimentation layer) by means of a lamella and which will make it more difficult for the fines to sediment in the area discharged downwards because of the reduced sedimentation speed. This special hydrocyclone is described in WO 2013/117342.

However, unstable conditions often arise in this hydrocyclone, particularly in the area of the flow reversal in the conical outlet area, which result in strong movement by the vortex in the core area and can thus cause the fractions originally separated to be mixed together again. In addition, individual streams may be discharged wrongly, which can also increase the amount of grains discharged wrongly, if the upward flowing core stream (with fines) and the downward flowing, washed underflow are close to one another.

Additionally, it has been shown that there is an increased amount of wrongly discharged core stream in the underflow, especially if the feed slurry has a high temperature. The problem is aggravated by the addition of wash water, which can also lead to significant dilution in the underflow.

SUMMARY

The invention is thus based on the task of improving a hydrocyclone operating with a layer of barrier fluid in such a way that it can be operated more easily under stable conditions, which will further reduce wrong discharge of fines or fine grains in the underflow. The fine material is thus to be depleted in the underflow with regard to the volume-related concentration in the inflow.

According to the present disclosure, this object is accomplished by the separation region comprising a conical section and a subsequent cylindrical section above the underflow discharge pipe.

This increases the distance between the flow reversal and the underflow outlet. The purpose of the cylindrical section is to move the sedimented coarse material concentrated by means of a rotary movement in a defined movement towards the discharge without giving the (transient) core flow the opportunity to run through into the underflow nozzle or the underflow discharge pipe. The cylindrical extension thus offers a kind of "solids cushion", which creates a calmed outlet zone through the conventionally arranged discharge nozzle.

In addition, this enables the use of a larger underflow nozzle than in conventional hydrocyclones with comparable outlet conditions in the underflow and overflow. Due to the possibility of using a larger underflow nozzle or a larger underflow discharge pipe, the operating reliability is enhanced because the risk of the underflow nozzle becoming blocked is reduced substantially.

Good separation results are achieved if the diameter of the cylindrical section is smaller than the height of the cylindrical section. It is favourable if the diameter of the cylindrical section measures at least 25 mm, preferably at least 30 mm.

The transition from the conical section to the cylindrical section should preferably be located a maximum of 100 mm after the barrier fluid feed, i.e. underneath the end of the lamella.

The lamella should preferably have a substantially cylindrical or conical shape. In the feed area or the cylindrical segment, it may extend in this case from the inflow region of the barrier fluid stream to the transition to the conical separation region or be secured in the conical region. As a result, sufficient time remains for a stable circular stream to form, both in the barrier fluid layer and in the feed slurry.

It is beneficial if the lamella tapers to a point at its lower end or is made as thin as possible so that the barrier fluid stream and the feed slurry can be combined so as to be as vortex-free as possible. The two streams should also continue to flow separately from one another as far as possible underneath the lamella.

In a favorable embodiment, the mouth orifice of the overflow nozzle extends into the region in which the barrier liquid flow and the feed slurry are carried along together.

The lamella may also have compensating orifices which form a connection between the feed slurry and the barrier fluid flow, thus resulting in pressure compensation between barrier fluid and suspension before the two layers meet up. Ideally, the barrier fluid is always subject to a somewhat higher pressure than the suspension in this case.

The hydrocyclone according to the invention is described below on the basis of three drawings. In these drawings:

DETAILED DESCRIPTION

Figure 1:
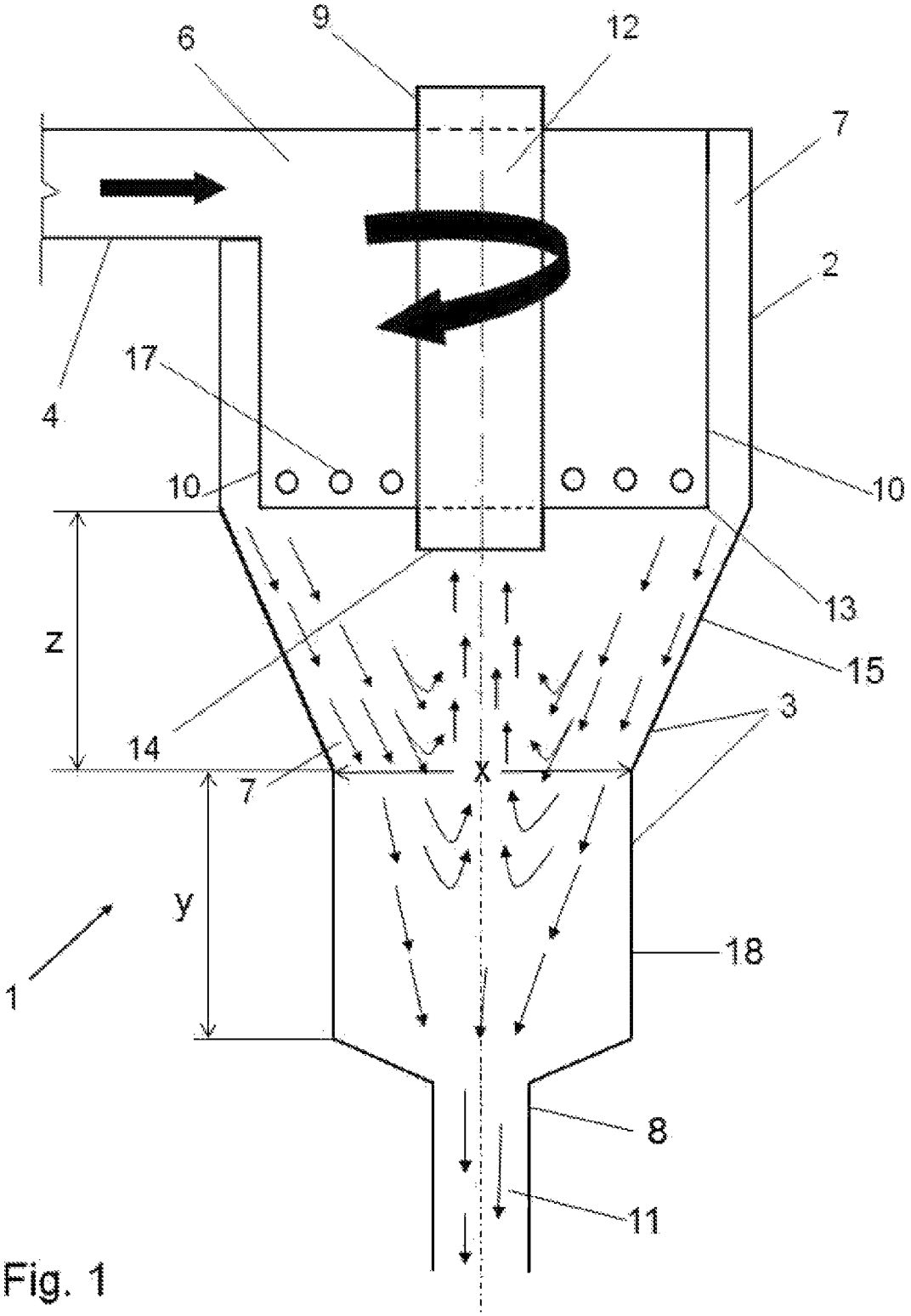
FIG. 1 shows a diagrammatic longitudinal section through an exemplary embodiment of the hydrocyclone according to the invention.

The same reference numbers in the drawing refer to the same components or material flows in each case.

The hydrocyclone 1 according to the disclosed embodiment of the invention is illustrated in FIG. 1. It is composed of an inflow region 2 and a subsequent separation region 3. The feed region 2 is cylindrical here. The separation region 3 includes an upper, conical section 15, which directly adjoins the feed region 2, and a lower, cylindrical section 18 adjoining the conical section 15. The diameter x of the cylindrical section 18 measures 30 mm here, and its height y (length of the section 18 viewed in axial direction) is 40 mm here. An underflow discharge pipe 8 for removing coarse material or coarse grains adjoins the cylindrical section 18 after the cross-section narrows. This discharge pipe 8 can act as a support for another nozzle or as the discharge nozzle itself.

A feed slurry 6 is supplied to the hydrocyclone 1 via the tangential inflow 4. The feed slurry 6 may be, for example, a gypsum suspension. The specifically lighter or finer-grained fraction can be discharged as overflow 12 through the overflow nozzle 9, which projects axially in the form of an immersion tube into the interior of the hydrocyclone 1, into the conical section 15.

In addition to the tangential inflow 4, the hydrocyclone 1 also has another inflow 5 (illustrated in FIG. 2) for the barrier fluid stream 7, which is also supplied tangentially to the inflow region 2 here. The barrier fluid 7 may, for example, be water, alcohol or oil. The barrier fluid stream 7 and the feed slurry 6 are fed to the hydrocyclone 1 separately and kept separate from one another in the hydrocyclone 1 by the lamella 10. The lamella 10 is, for example, a cylindrical, thin-walled component made of metal. The pure barrier fluid stream 7 meets up with the actual suspension flow (feed slurry 6) at the lower end 13 of the lamella 10. This occurs as soon as the streams of the barrier fluid 7 and the feed slurry 6 have a stable form.

The distance z from the bottom end of the lamella 10 to the transition from the conical section 15 to the cylindrical section 18 is less than 100 mm here.

After the two volumetric flows 6, 7 have been merged, a settling movement of heavy fractions (coarse materials) commences through the barrier layer 7. This results in depletion of the fines in the underflow 11. In the conical section 15 of the separation region 3, the stream is routed in the same way as in conventional hydrocyclones.

The lamella 10 has compensating orifices 17 here, which represent a connection between the feed slurry 6 and the barrier fluid flow 7, resulting in pressure compensation between the barrier fluid 7 and the suspension 6. These compensating holes are also conceivable in the region of the inflow 5.

The flow arrows indicate that the barrier fluid stream 7 and the feed slurry 6 are intermixed with one another as little as possible. The barrier fluid stream 7 thus forms a barrier fluid layer 7 towards the wall of the conical section 15.

In the cylindrical section 18, the coarse material that has sedimented has enough space to move specifically towards the underflow discharge pipe 8 by means of a rotating movement. In addition, this cylindrical extension 18 prevents the core flow from running through into the actual underflow 11.

The mouth orifice 14 of the overflow nozzle 9 ends at a slightly lower elevation than the lower the end 13 of the lamella 10.

Depending on the respective volume fractions in the barrier fluid flow 7 and in the feed slurry 6, the heavy fraction (coarse materials) will be discharged with more accuracy or less.

Figure 2:
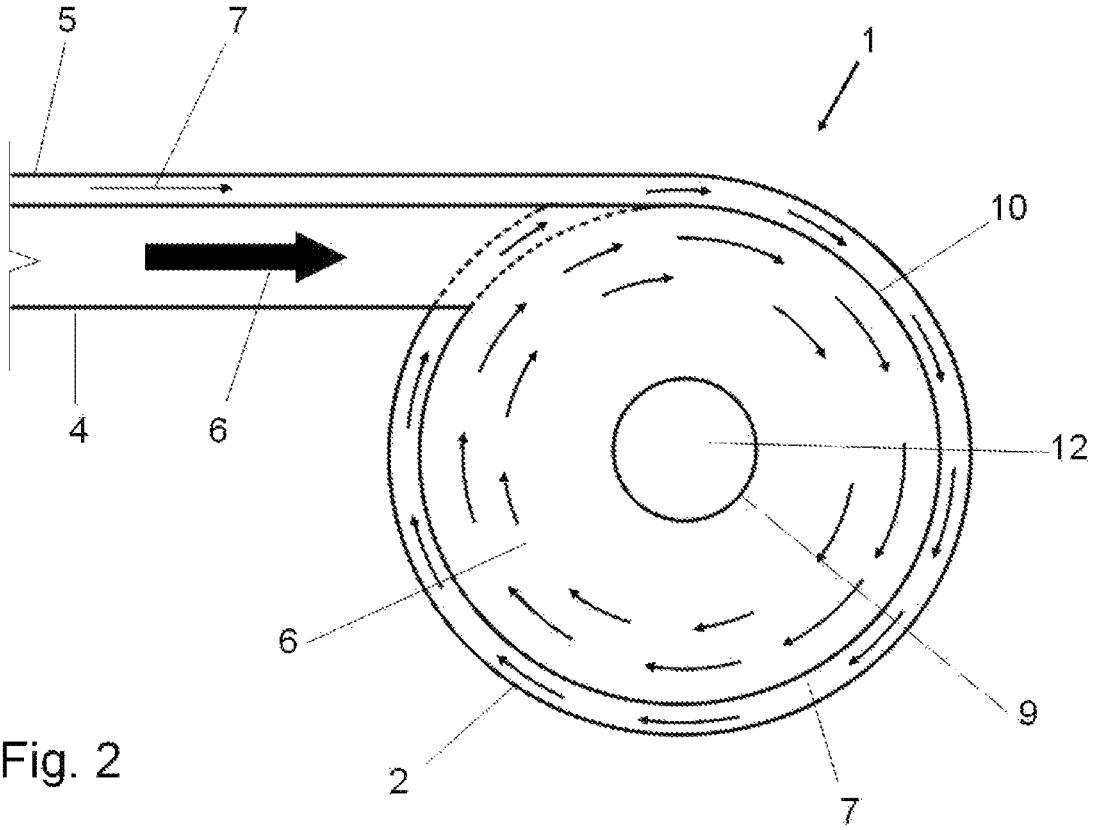
FIG. 2 shows a cross-section in the region of the inflow through the hydrocyclone according to the invention.

FIG. 2 shows a cross-section through a hydrocyclone 1 according to the invention in the region of the inflow. This clearly shows the tangential inflow 4 for the feed slurry 6 and the tangential inflow 5 for the barrier fluid layer 7. These two inflows 4, 5 flow into the inflow region 2 here substantially in parallel.

Figure 3:
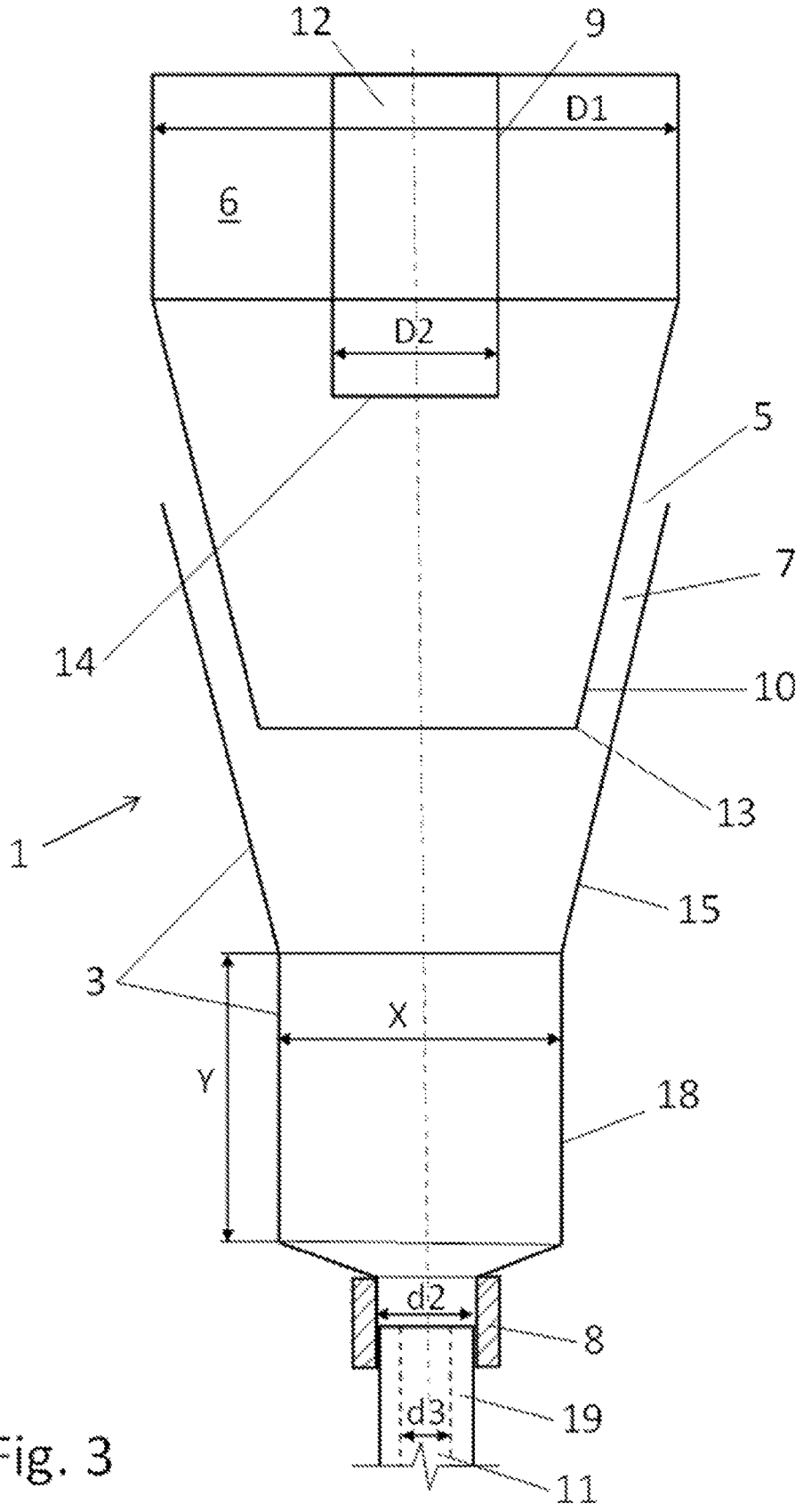
FIG. 3 shows a diagrammatic longitudinal section through another exemplary embodiment of the hydrocyclone according to the invention.

FIG. 3 shows another exemplary embodiment of the hydrocyclone 1 according to the invention. The diameter D1 of the inlet region is 75 mm here, and the inner diameter D2 of the overflow nozzle measures 25 mm. This hydrocyclone has a conical lamella 10, which extends into the conical section 15 of the separation region 3. The other feed 5 for supplying the barrier fluid 7 is located between the conical lamella 10 and the conical section 15 of the separation region 3. The cylindrical section 18 adjoining the conical section 15 has a height y of 150 mm here and a diameter x of 37 mm. The underflow discharge pipe 8 with an initial diameter d2 of 25 mm and a final diameter of 10 mm is arranged underneath the cylindrical section 18. The sudden change in the diameter in the underflow nozzle occurs here because a nozzle 19 for discharging the underflow Ills pushed into the underflow discharge pipe 8. Of course, the underflow nozzle can also have a uniform diameter of, for example, 10 mm. The dimensions mentioned here refer to a hydrocyclone that achieved very good results in the test plant; of course, it is also possible to achieve very good results with other dimensions as well.

The invention claimed is:

1. A hydrocyclone comprising:

an inflow region that has a tangential inflow path for a feed slurry; a separation region following the inflow region with an underflow discharge pipe for the discharge of relatively heavy materials, and an overflow nozzle projecting axially into the interior of the hydrocyclone;

at least one other inflow path provided in the inflow region to supply a barrier fluid stream;

a lamella in the inflow region, separating the inflow path for the slurry from the inflow path for the barrier fluid until the barrier fluid and the slurry are combined in the separation region; and wherein the separation region includes a conical section adjoining the inflow region and an adjoining cylindrical section of the separation region at the outlet of the conical section, leading directly to the underflow discharge pipe, and the cylindrical section has a flow cross section and the discharge pipe has a flow cross section that is smaller than the flow cross section of the cylindrical section.

2. The hydrocyclone according to claim 1, wherein the cylindrical section has a diameter (x) and a height (y) and said diameter (x) is smaller than said height (y).

3. The hydrocyclone according to claim 1, wherein the lamella has a lower end;

the barrier fluid and the slurry are combined in the separation region at the lower end of the lamella; and the conical section is adjoined to the cylindrical section at a distance no greater than 100 mm from the lower end of the lamella.

4. The hydrocyclone according to claim 1, wherein the cylindrical section has a diameter (x) of at least 25 mm.

5. The hydrocyclone according to claim 1, wherein the lamella is substantially cylindrical.

6. The hydrocyclone according to claim 1, wherein the lamella is substantially conical.

7. The hydrocyclone according to claim 1, wherein the inflow region transitions to the separation region at a transition elevation and the lamella has a lower end that extends through the infeed region to said transition elevation.

8. The hydrocyclone according to claim 1, wherein the lamella extends into the separation region.

9. The hydrocyclone according to claim 1, wherein the lamella has a lower end;

the barrier fluid and the slurry are combined in the separation region at the lower end of the lamella; and the overflow nozzle extends into the separation region with a mouth below the lower end of the lamella.

10. The hydrocyclone according to claim 1, wherein the lamella includes a conical section with a lower end that is within the conical section of the separation region; and the barrier fluid stream and the feed slurry are combined within the conical section of the separation region at the lower end of the lamella.

11. The hydrocyclone according to claim 2, wherein the lamella has a lower end;

the barrier fluid and the slurry are combined in the separation region at the lower end of the lamella; and the conical section is adjoined to the cylindrical section at a distance no greater than 100 mm from the lower end of the lamella.

12. The hydrocyclone according to claim 2, wherein the inflow region transitions to the separation region at a transition elevation and the lamella has a lower end that extends through the infeed region to said transition elevation.

13. The hydrocyclone according to claim 12, wherein the barrier fluid and the slurry are combined in the separation region at the lower end of the lamella; and the overflow nozzle extends into the separation region with a mouth below the lower end of the lamella.

14. A hydrocyclone for separating relatively heavy, coarse materials in slurry from relatively lighter fine material in the slurry as a result of rotation about a cyclone axis, comprising:

an inflow region that has a tangential inflow path for a feed slurry;

at least one other inflow path provided in the inflow region to supply a barrier fluid stream;

a lamella in the inflow region, separating the inflow path for the slurry from the inflow path for the barrier fluid until the barrier fluid and the slurry are combined in a separation region of the hydrocyclone, following the inflow region;

wherein said separation region extends axially and the slurry is rotated about said axis whereby the separated coarse material concentrates radially outward and flows axially to an outlet of the separation region and the separated fine material concentrates radially inward and moves in reverse axial flow within the separated coarse material;

an underflow discharge pipe at the outlet of the separation region for the discharge of the separated coarse materials, and an overflow nozzle projecting axially into the interior of the hydrocyclone for discharge of the separated fine material;

wherein the separation region includes a conical section directly adjoining the inflow region, and an adjoining cylindrical section defining the outlet of the separation region and directly adjoining the discharge pipe;

wherein in both the conical section and cylindrical section, separated coarse material concentrates radially outward and flows axially toward the outlet of the separation region and the separated fine material concentrates radially inward and moves in reverse axial flow within the separated coarse material; and wherein the cylindrical section has a flow cross section and the discharge pipe has a flow cross section that is smaller than the flow cross section of the cylindrical section.

15. The hydrocyclone of claim 14, wherein the separated fine material in the cylindrical section moves in said reverse flow from the cylindrical section to the conical section without reaching the outlet of the separation region.

* * * * *